US005156270A

United States Patent [19]

Kachel et al.

[11] Patent Number: 5,156,270

[45] Date of Patent: Oct. 20, 1992

[54] PACKAGE FOR STORING AND DISPENSING UNFOLDED FILE FOLDERS

[75] Inventors: Theodore V. Kachel, Purchase, N.Y.; Alexander E. Morris, Princeton, N.J.

[73] Assignee: Esselte Pendaflex Corporation, Garden City, N.Y.

[21] Appl. No.: 760,646

[22] Filed: Sep. 16, 1991

[51] Int. Cl.[5] ..... B65D 85/00; B65B 35/50

[52] U.S. Cl. ..... 206/451; 53/442; 53/447; 53/475; 206/497; 229/122; 229/178

[58] Field of Search ..... 206/449, 451, 497, 215, 206/499; 229/178, 243, 244, 122, 917; 53/447, 475, 441, 442

[56] References Cited

U.S. PATENT DOCUMENTS

| | | | |
|---|---|---|---|
| 1,715,021 | 5/1929 | Wolf | 229/122 X |
| 2,835,378 | 5/1958 | Sramek | 229/244 X |
| 3,086,649 | 4/1963 | Johnson . | |
| 3,181,695 | 5/1965 | Taterka et al. . | |
| 3,273,302 | 9/1966 | Walter | 206/497 X |
| 3,401,609 | 9/1968 | Nelson . | |
| 3,585,776 | 6/1971 | Euwe . | |
| 3,696,580 | 10/1972 | Saltzer, Sr. | 206/497 X |
| 3,716,962 | 2/1973 | Langen et al. | 493/180 X |
| 3,828,659 | 8/1979 | Reichert | 493/313 |
| 3,887,126 | 6/1975 | Wilson | 229/178 X |
| 3,943,681 | 3/1976 | Preisig | 53/447 X |
| 4,042,168 | 8/1977 | Kasel et al. | 229/40 |
| 4,133,430 | 1/1979 | Cravens | 206/497 |
| 4,494,362 | 1/1985 | Koch . | |

OTHER PUBLICATIONS

Research Disclosure No. 20103 by R. E. Grady et al. (Jan. 1981).

*Primary Examiner*—Bryon P. Gehman
*Attorney, Agent, or Firm*—Pennie & Edmonds

[57] ABSTRACT

An apparatus for storing and dispensing unfolded files comprising a tray which has side walls, a bottom, and an open top is provided. The tray is adapted to store a stack of the unfolded files thereon. A plastic film is wrapped around the tray and unfolded files contained therein to retain the unfolded files in a tray and to form a package. Upon removal of the plastic film, the unfolded files may be removed from within the tray. Methods for storing and dispensing the unfolded files are also provided.

23 Claims, 3 Drawing Sheets

PACKAGE FOR STORING AND DISPENSING UNFOLDED FILE FOLDERS

BACKGROUND OF THE INVENTION

1. Field of the Invention

The present invention relates to file folders, and, in particular, to a method and apparatus for easily and economically storing, transporting, and dispensing unfolded file folders.

2. Description of the Prior Art

In the past, after file folders were stamped or cut into a desired configuration from a web of paper such as manila, the flat file folders were folded for packaging, packaged and sent to distributors for ultimate sale to consumers. After being folded, these files, comprising a front flap, a fold crease, and a rear flap, were placed in a conventional two-piece (top and bottom) telescopic box. These files have always been packaged in a folded condition, and the distributors have come to accept receiving the files in this manner. However, the applicants have now recognized that this folding operation is wasteful and unnecessarily increases the costs of the folders.

Folding the folders for packaging unnecessarily increases the cost of the folders because the volume of space necessary to store and transport folded file folders is greater than the volume of space necessary to store unfolded file folders. When a file folder is folded, its effective thickness is greater than the sum of the thicknesses of the front and rear flaps because the thickness of the file along the fold crease is greater than the sum of the thicknesses of the front and rear flaps. This thickness variation seems inconsequential when considered individually and was previously considered to have a negligible effect on the volume of space occupied by folded file folders. Thus, file folders continued to be stored and distributed in a folded condition.

However, applicants have recognized that when hundreds and thousands of file folders are stacked for storage and transportation to distributors, the thickness variations become substantial and cause the entire stack of folded files to be much thicker than simply the total sum of the front and rear flaps. Also, the thicker the material of the folder, the greater the difference in thickness when the folder is folded. Accordingly, the volume of space occupied by folded file folders is much larger than the volume of space that would be occupied by the same number of unfolded file folders. This larger volume translates directly into needlessly increased storage and transportation costs for the file folders, which, in turn, translate directly into increased costs to consumer.

Further, the process of folding the files is wasteful because additional processing steps, machinery, and quality control checks are required. These additional steps also create increased costs for the consumer.

Accordingly, there is a need for a new packaging of file folders so that the costs associated with manufacturing, storing, and transporting same may be reduced.

SUMMARY OF THE INVENTION

In accordance with the present invention, there is provided a package for storing and dispensing file folders comprising a tray which has side walls, a bottom, and an open top. The tray is preferably made from a blank of corrugated cardboard, and is adapted to store a plurality of unfolded file folders therein. A plastic film is shrink wrapped around the tray to retain the unfolded file folders in the tray and to form a package. Upon removal of at least a portion of the plastic film, the unfolded file folders may be removed from within the tray. Methods for storing and dispensing the unfolded files are also provided. For example, a perforated portion which can be removed to form a lip portion or notch may be provided on at least one side of the tray to facilitate dispensing of the file folders.

DETAILED DESCRIPTION OF THE PREFERRED EMBODIMENTS

Figure 1:
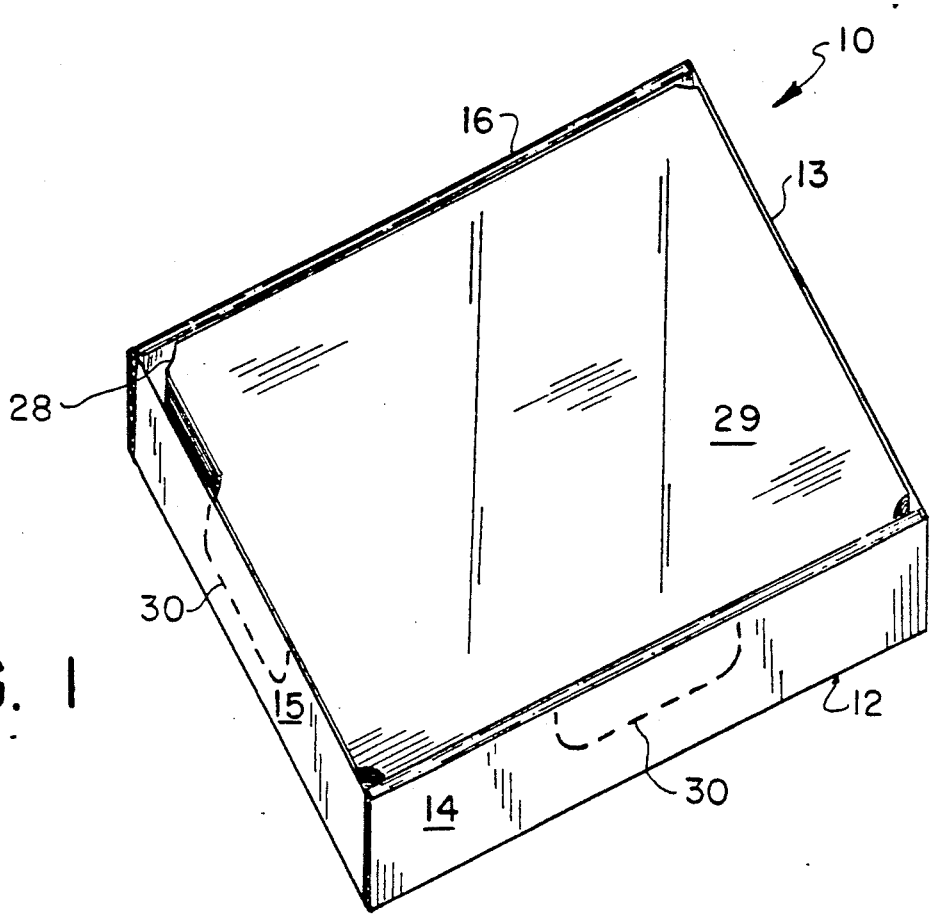
FIG. 1 is a perspective view of one embodiment of a package for storing and dispensing file folders in accordance with the present invention.
Figure 2:
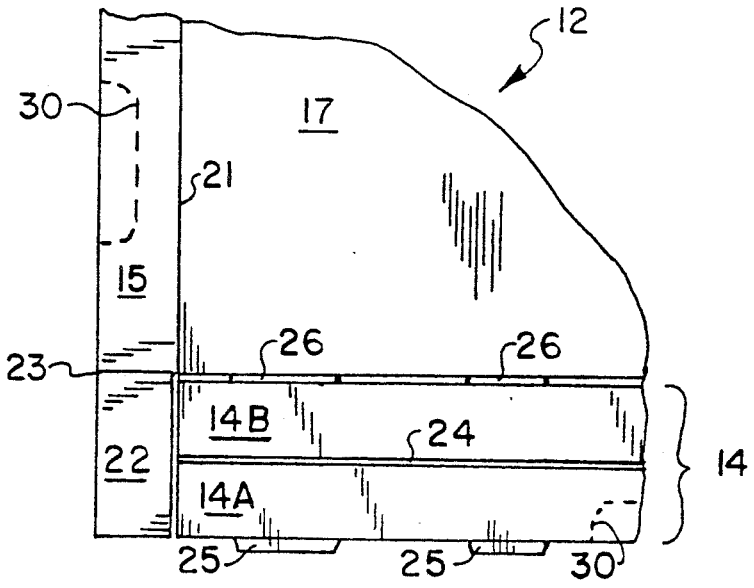
FIG. 2 is an exploded view of a portion of the tray used in the package of FIG. 1.

Referring initially to FIGS. 1 and 2, there is illustrated a first embodiment of a storing and dispensing package 10 for unfolded file folders in accordance with the present invention. Package 10 includes tray 12 having side walls 13, 14, 15, 16 and bottom portion 17. The top of the tray is open to receive the folders. Tray 12 is preferably made of corrugated cardboard and is formed from a blank of such material, a portion of which is shown in FIG. 2. As can be appreciated by one skilled in the art, side walls 13 and 15 are essentially the same, as are side walls 14 and 16. This blank is die stamped from a flat sheet or supply roll of corrugated cardboard, with the appropriate perforations and cutouts provided.

To form the tray 12 from the blank, side walls 13 and 15 are initially folded along crease line 21 to a position which is perpendicular to the bottom portion 17. Ends 22 are then bent along crease line 23 to form a right angle in the corner. Although only one end 22 is shown in FIG. 2, it should be realized that each corner includes one end 22, as they are included on each end of side walls 13 and 15.

After the ends 22 are positioned as described above, sidewall 14 is formed as a "double" side wall consisting of portions 14A and 14B. Side wall 14A is folded along crease line 24 to lie on top of side wall 14B, so that a plurality of tab members 25 provided on side wall 14A can engage mating slots 26. Side wall 14A is also folded over end 22 so that, when tab members 25 engage slots 27, a tray corner is formed. When the opposite end of side wall 15 and the ends of all four side walls 13, 14 and 16 are folded in the same manner (not shown), formation of the tray 12 is complete.

Thereafter, the tray 12 is filled with a plurality of unfolded file folders 28, and is shrink wrapped with polyethylene film 29 to form the package.

Perforations 30 may be provided on any one or all four side walls 13, 14, 15, 16, as desired. These perforations 30 can be removed by the user (after the film 29 has been totally or partially removed from the package) to form a lip portion or side wall notch which facilitates dispensing of the folders from the package. Generally two perforations 30 are provided: one on sidewall 14 and one on sidewall 15 so that the user can dispense folders from either side of the package when it is stored on a shelf. The size of the notch or lip portion is not critical, as it is used only to provide better access to the folders 28 inside of tray 12 when the folders are to be dispensed.

The overall package has a relatively flat profile. When letter sized standard weight manila folders are used, the dimensions of the package are 19⅛" long, 12⅛" wide and 1¼" high, with a weight of 5.7 pounds. In comparison, conventional two piece telescopic box packaging of folded letter size file folders of standard weight manila material have dimensions of 12" long, 9⅞" wide and 2½" high, with a weight of 6 pounds. Thus, the inventive package has a volume of less than 290 cubic inches compared to over 296 cubic inches for the conventional package: a savings in volume of about 2.2%. Also, a weight reduction of about 5 percent is achieved. For a typical order of 5000 file folders (i.e., 50 packages of 100 folders), a savings in volume of greater than 300 cubic inches (i.e., more than the size of one package) is achieved over the conventional packaging. In addition, the packages of the invention are 15 pounds lighter. These advantages are surprising in that they are achieved by omitting the folding of the file folders prior to packaging and providing the novel tray described above.

Another important consideration is that the corrugated cardboard of the tray 12 can be made of recycled material, whereas conventional packaging boxes are not. This creates an environmentally harmonious package which can be recycled.

Figure 3:
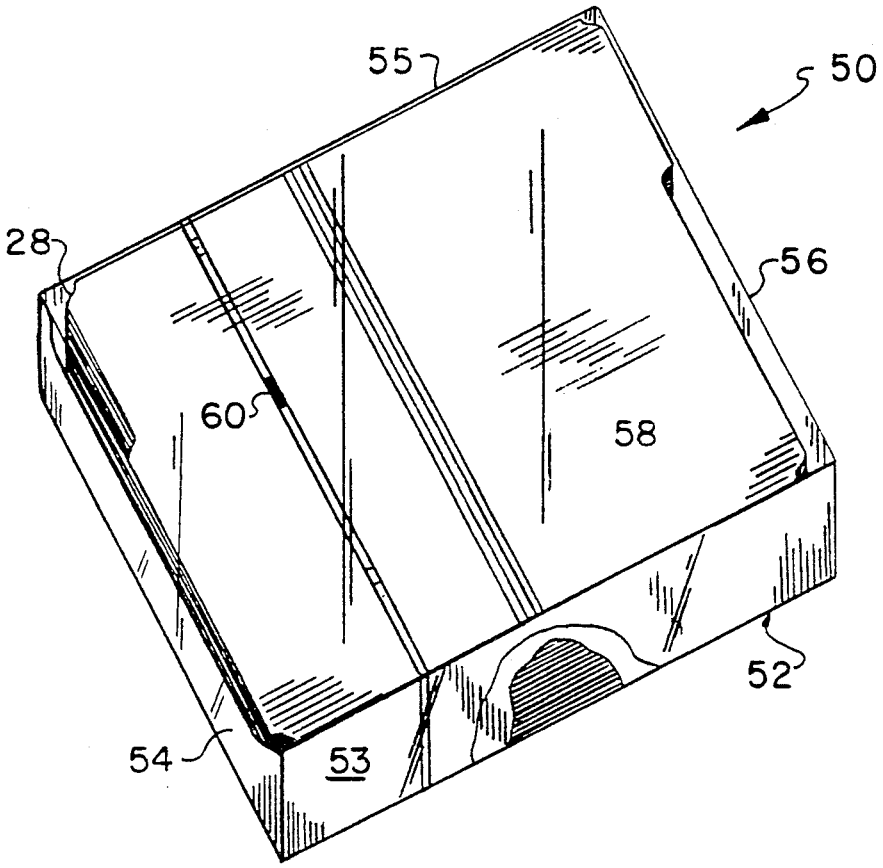
FIG. 3 is perspective view of a second embodiment of a package for storing and dispensing file folders in accordance with the present invention.
Figure 5:
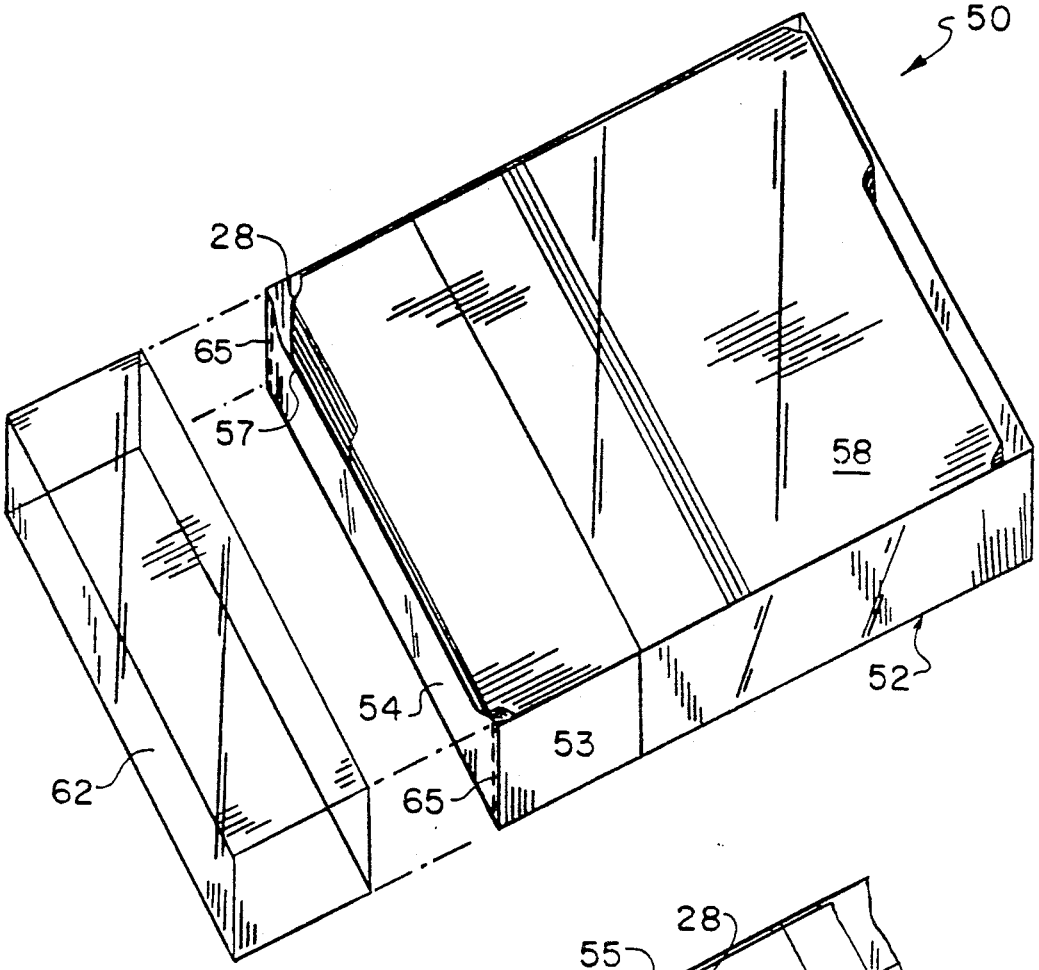
FIG. 5 is a perspective view of the package of FIG. 3 with a portion of the plastic film removed.

Referring now to FIG. 3, there is illustrated a second embodiment of a package generally designated by the numeral 50 for storing and dispensing of file folders 28. Package 50 also comprises a tray 52 formed from side walls 53, 54, 55, 56, a bottom and an open top. As can be seen in FIGS. 3 and 5, the upper edge of side wall 54 adjacent to open top is provided with a longitudinal notch 57 which facilitates dispensing of file folders therefrom.

Figure 4:
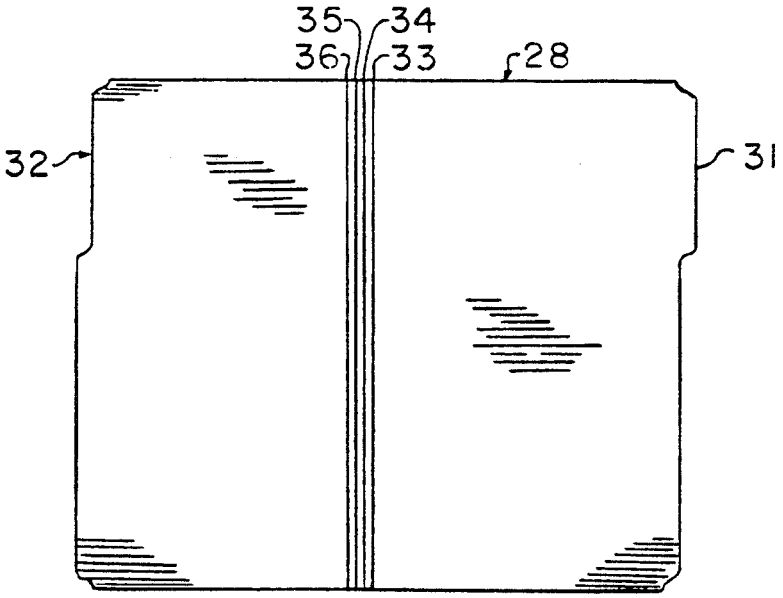
FIG. 4 is a plan view of a file folder for use with the packages of FIGS. 1 or 3.

As shown in FIG. 4, file folders 28 generally comprise a sheet of paper such as manila or oaktab which is cut or stamped into a desired configuration from a web of the paper. In a preferred arrangement, file folder 28 is designed to have a tab portion 31 at one end and a window portion 32 at the opposite end. When file folder 28 is folded in half, tab 31 is visible to the user. After file folder 28 has been formed, at least one crease line 33 is made in approximately the center of file folder by known methods. Although file folder 28 is described as having a single crease line 33, it is possible and often desirable for the folder to have a plurality of such crease lines 34, 35, 36 which may be utilized depending on the thickness of materials to be placed within file folder 28. However, file folder 28 is not folded along any of the crease lines until after it is removed from the package and when it is to be used by the consumer.

As noted above, a plurality of file folders 28 are stored in tray 52. A shrinkable plastic film 58, such as polyethylene or the like, is wrapped around tray 52 and heat sealed to form a final package around the folders.

When access to file folders 28 is desired, film 58 is removed from the package, thereby allowing access to file folders 28 through open top of tray 52. One or more file folders 28 may then be removed from within tray 52, and notch 57 facilitates this removal. The size of the notch 57 is not critical, and FIG. 5 illustrates a larger notch than the lip portion of FIG. 1. As shown in FIG. 1, perforations to form notch 57 can also be used, if desired. File folder 28 is then merely converted to the appropriate use position by folding along the desired crease line 33, 34, 35, or 36.

In a preferred embodiment, shown in FIGS. 3 and 5, film 58 is provided with a tear tab 60. By withdrawing tear tab 60 from the package, the consumer may remove only a portion 62 of film 58 from package to obtain access to file folders 28 stored therein, while still allowing the balance of the film 58 to remain on the package. Thus, even after the package has been opened, the balance of film 58 will maintain file folders 28 within tray 52.

Figure 6:
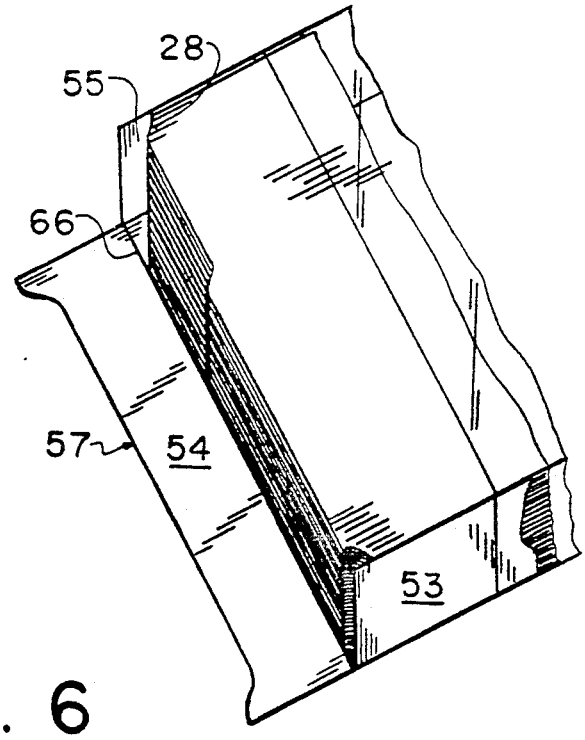
FIG. 6 is a detailed perspective view of one side of the package of FIG. 5 with one side of the tray pivoted about the bottom of the tray to an open position.

As shown in FIGS. 5 and 6, it is also preferable to include perforated portions 65 on the ends of sides 53 and 55 in the corners of the tray 52. These perforated portions 65 allow side wall 54 to pivot along its connection 66 with the tray bottom to expose the edges of the folders 28, thereby allowing easy access to folders 28 stored in tray 52.

Thus, in use, the consumer simply removes the portion 62 of film 58 by pulling tear tab 60, pivoting side wall 54 to expose the edges of folders 28, and then remove one or more file folders from within tray 52. The consumer then merely converts folder 28 to the appropriate use position by folding along one of the crease lines.

Storing folders 28 within tray 52 in the manner described above provides for unexpectedly easy and economical storage and transport. The tremendous savings in the amount of space required to store and transport hundreds and thousands of files is readily apparent. These savings translate directly into reduced storage and transporting costs for the files, which translates directly into reduced file costs to the consumer.

Additionally, since these files are not folded prior to being packaged, the additional processing steps required to create the folded file may be omitted. This omission also reduces the file cost to the consumer.

The steps which are followed to prepare the package of the present invention are thus as follows: Initially, a web of manila paper is fed to a die stamping machine where the desired configuration of file folder 28 is formed. Folder 28 then passes beneath a scoring roller where the crease lines are formed. Thereafter, a predetermined number of scored flat file folders 28 are stacked.

The desired tray is then formed by stamping a blank of corrugated cardboard and folding the ends and side walls as noted above. A stack of folders is then placed into the tray. On top of the folders, advertising or other information regarding the contents of the package may be placed. As is evident from the dimensions of the package of the invention, a much larger area is provided for such information than the prior art boxes.

The operation next proceeds to a shrink wrap station where plastic film is shrink wrapped or stretch wrapped around the tray to form the final package. Finally, when a tear tab is utilized, the package is then advanced to a banding station where a tear tab is applied to the plastic film.

The package is then sent to the designated area for shipping to distributors. Preferably, a plurality of packages will be stored within a larger container or upon a pallet for convenience in transport.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

We claim:

1. A package for storing and dispensing unfolded file folders comprising:

a plurality of file folders in an unfolded state, each folder having a first pair and a second pair of opposed edges forming a generally rectangular shape and at least one crease line extending generally perpendicular to the first pair of opposed edges, each file folder being foldable along one crease line to form a folded state after being removed from the package, each unfolded folder having a first length measured perpendicular to the one crease line and between furthest points of the second pair of opposed edges, and a second length measured perpendicular to the one crease line and between the one crease line and a furthest point of either of the second pair of opposed edges;

a tray dimensioned to receive the plurality of file folders in the unfolded state, the tray having a generally rectangular bottom with two pairs of opposed sidewalls extending perpendicular thereto and an open top, with a first inside dimension and a second inside dimension between the pairs of opposed sidewalls, wherein the first inside dimension of the tray is larger than the first length of the unfolded folder but less than twice the second length of the folded folder; and a plastic film covering the open top to retain the file folders with the tray.

2. The package of claim 1, wherein at least one of the side walls is provided with a notch to facilitate removal of the folders from the tray.

3. The package of claim 1, wherein the plastic film is shrink wrapped or stretch wrapped around the tray to confine the file folders within the tray.

4. The package of claim 1, further comprising a tear tab in the film for removing a portion of the plastic film from the package while retaining the remainder around the tray for retaining the file folders upon removal of the tear tab.

5. The package of claim 1, wherein the tray is formed from a corrugated cardboard blank.

6. The package of claim 5, wherein the blank is substantially rectangular and one of the two pairs of opposed side walls is formed by bending two opposed edges of the blank, wherein the one pair of opposed side walls has ends which form corners of the tray.

7. The package of claim 6, wherein the other pair of opposed side walls is formed by bending the other two opposed edges of the blank, wherein the other pair of opposed side walls receives the ends of the one pair of opposed side walls to form the corners of the tray.

8. The package of claim 7, wherein the other two opposed edges of the blank which form the other pair of opposed side walls are folded twice to form double-walled side walls.

9. The package of claim 8, further comprising slots formed adjacent the bottom of the other pair of opposed side walls and tab members extending from the other two opposed edges of the blank, wherein the tab members engage the slots after folding the other two opposed edges twice to retain the double-walled side walls.

10. The package of claim 7, wherein the ends of at least one of the side walls include perforations in at least two adjacent corners for allowing pivotal movement of the at least one of the side walls about the bottom of the tray to facilitate removal of the folders from the tray after the perforations are broken.

11. The package of claim 1, wherein one of the second pair of edges of the file folder includes a tab extending perpendicular to the first pair of edges of the file folder and the first length of the unfolded file folder includes the dimension of the tab.

12. The package of claim 11, wherein the second length of the folded file folder includes the dimension of the tab.

13. The method of packaging and dispensing unfolded file folders comprising the steps of:

providing a tray dimensioned to receive a plurality of the file folders in the unfolded state, wherein the tray has a generally rectangular bottom with two pairs of opposed sidewalls extending perpendicular thereto and an open top, with first and second inside dimensions between the pairs of opposed sidewalls;

inserting the file folders inside the tray in the unfolded state, wherein each folder in an unfolded state has a first pair and a second pair of opposed edges forming a generally rectangular shape and at least one crease line extending generally perpendicular to the first pair of opposed edges, each file folder being foldable along one crease line to form a folded state after being removed from the package, each unfolded folder having a first length measured perpendicular to the one crease line and between furthest points of the second pair of opposed edges, and a second length measured perpendicular to the one crease line and between the one crease line and a furthest point of either of the second pair of opposed edges, wherein the first inside dimension of the tray is larger than the first length of the unfolded folder but less than twice the second length of the folded folder; and covering the open top with a plastic film to retain the file folders within the tray.

14. The method of claim 13, further comprising the step of providing a notch in at least one of the side walls to facilitate removal of the file folders from the tray.

15. The method of claim 13, wherein the plastic film is shrink wrapped or stretch wrapped around the tray to confine the file folders within the tray.

16. The method of claim 13, wherein the plastic film is provided with a tear tab for removing a portion of the plastic film from the package while retaining the remainder around the tray for containing the file folders within the tray upon removal of the tear tab.

17. The method of claim 13, wherein the tray is formed from a corrugated cardboard blank.

18. The method of claim 17, wherein the blank is substantially rectangular and one of the two pairs of opposed side walls is formed by bending two opposed edges of the blank and the other pair of opposed side walls is formed by bending the other two opposed edges of the blank, wherein the one pair of opposed side walls has ends and the other pair of opposed side walls receives the ends to form corners of the tray.

19. The method of claim 18, wherein the other two opposed edges of the blank which form the other pair of opposed side walls are folded twice to form double-walled side walls.

20. The method of claim 19, wherein slots are formed adjacent the bottom of the other pair of opposed side walls and tab members extend from the other two opposed edges of the blank, wherein the tab members engage the slots after folding the other two opposed edges twice to retain the double-walled side walls.

21. The method of claim 18, wherein the ends of at least one of the side walls include perforations in at least two adjacent corners for allowing pivotal movement of the at least one of the side walls about the bottom of the tray to facilitate removal of the folders from the tray after the perforations are broken.

22. The method claim 13, wherein one of the second pair of edges of the file folder includes a tab extending perpendicular to the first pair of edges of the file folder and the first length of the unfolded file folder includes the dimension of the tab.

23. The method of claim 22, wherein the second length of the folded file folder includes the dimension of the tab.

* * * * *